US006360908B1

(12) United States Patent
Kline

(10) Patent No.: US 6,360,908 B1
(45) Date of Patent: Mar. 26, 2002

(54) TAMPER-EVIDENT DRUM CLOSURE OVERCAP

(75) Inventor: Thomas A. Kline, Fort Wayne, IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 09/444,198

(22) Filed: Nov. 19, 1999

(51) Int. Cl.[7] ..... B65D 51/18

(52) U.S. Cl. ..... 220/257; 220/276; 220/601; 220/254

(58) Field of Search ..... 220/257, 214, 220/256, 254, 601, 276; 215/251, 256, 258, 277, 278, 250; 222/153.06, 541.6, 153.1

(56) References Cited

U.S. PATENT DOCUMENTS 3,122,261 A * 2/1964 Parish, Jr. et al. ..... 220/257
3,474,930 A * 10/1969 Lerner ..... 220/257
4,164,304 A * 8/1979 Roberson ..... 220/257 X
4,387,818 A * 6/1983 Conti ..... 215/256
4,775,063 A * 10/1988 Godfrey ..... 215/256 X
4,909,404 A * 3/1990 Rozenberg ..... 215/256 X
5,038,951 A * 8/1991 Rizzardi ..... 215/251 X
5,129,531 A * 7/1992 Beck et al. ..... 215/256
5,730,309 A * 3/1998 Jiradejnunt et al. ..... 220/276
5,829,611 A * 11/1998 Beck ..... 215/256 X
5,971,183 A * 10/1999 Bartsch ..... 215/256
5,996,833 A * 12/1999 Lencioni et al. ..... 220/257

* cited by examiner

*Primary Examiner*—Nathan J. Newhouse
(74) *Attorney, Agent, or Firm*—Woodard, Emhardt, Naughton, Moriarty & McNett

(57) ABSTRACT

A unitary, plastic, snap-on overcap for providing a tamper-evident capability to a closure assembly of a container includes a cap, a removable skirt, and a plurality of spaced-apart frangible elements which connect the removable skirt to the cap. The closure assembly includes an internally-threaded fitting which is anchored into the container and an externally-threaded closing plug which is installed into the fitting. The cap portion of the overcap includes a depending sidewall which terminates in a snap-on lip portion. The removable skirt includes a wall portion which is constructed and arranged to be positioned in close proximity to an upper surface of the container when the cap is snapped onto the closure assembly. The actual snap-on engagement of the cap to the closure assembly involves engagement by the lip portion with a cooperating edge of the closure assembly. In order to gain access to an edge of the cap in order to pry the cap off of the closure assembly, the skirt must be removed. In order to remove the skirt, the spaced-apart frangible elements must be severed. The tamper-evident capability is created by placement of the skirt in close proximity to a surface of the container such that the cap cannot be pried off without first breaking one or more of the frangible elements. Breakage of any of the frangible elements provides a visual indication of a tampering attempt.

27 Claims, 7 Drawing Sheets

TAMPER-EVIDENT DRUM CLOSURE OVERCAP

BACKGROUND OF THE INVENTION

The present invention relates to an all-plastic, tamper-evident overcap for the closure portion or component of a shipping and storage container. This container which is typically a steel drum includes a drum end or head which typically includes a closure for dispensing the contents of the container and a closure for venting the container. More particularly the present invention relates to a tamper-evident overcap which is constructed and arranged to snap fit onto a portion, typically a radially extending lip or circumferential edge, of the corresponding steel drum closure.

In one embodiment of the present invention a frustoconical outer skirt is connected to the cap by a series of frangible elements. In a related embodiment the outer skirt, while still tapered to some degree, has a more cylindrical appearance and comprises the outer wall of the overcap, prior to separation from the snap-on cap. In both embodiments the overcap is unable to be removed without cutting or tearing away the snapped-on cap portion or without removal of the skirt so that the cap portion can be pried off. Either approach provides a visible indication of a tampering attempt. If the skirt is removed by breaking the series of frangible elements that connect the skirt to the cap, it is then possible to pry off the cap from its snap-fit onto the closure, without giving any further indication of a tampering attempt. However, the absence of the skirt, if unauthorized, would visually indicate a tampering attempt.

The present invention is directed to use with large shipping containers or drums where one drum end is arranged with a plug-type closure and an internally-threaded fitting, typically with a threaded interfit between the two. Due to the limited thickness of the drum end material and the desire to create an internally-threaded dispensing port, an internally-threaded fitting or flange is typically anchored into the drum end or head so as to provide a dispensing opening. The method of anchoring the flange fitting into the drum end involves the forming or drawing of the drum end material into a raised and shaped pocket. The next step is to place the flange fitting into the pocket and then form or crimp the metal of the drum end onto and around the flange fitting so as to anchor these two components together. The flange fitting is internally threaded and receives a closing plug and cooperating annular gasket in order to seal closed the internally threaded aperture defined by the flange fitting. Threaded removal of the closing plug enables the contents of the drum to be dispensed.

Without some type of tamper-evident feature, the closing plug could be removed at virtually any time, such as during shipping or storage, without being noticed. This would mean that someone could tamper with the drum contents without being discovered. This tampering could include partial removal of the drum contents and/or contamination of the drum contents by a foreign substance. Having a tamper-evident feature provides a desirable enhancement to the plug-flange fitting combination. It then becomes important to configure a tamper-evident feature which is reliable, easy to install or assemble, and relative inexpensive. The unitary, molded plastic design of the present invention satisfies the "inexpensive" criteria. The snap-on or snap-fit design of the present invention satisfies the "easy to install" criteria and cooperates in satisfying the "reliable" criteria. The use of a removable (i.e., frangible) skirt as disclosed by the present invention satisfies the "reliable" criteria and does so in a novel and unobvious manner.

One of the keys to the success of the present invention is the placement of the underside (i.e., lower) edge of the frangible skirt against the surface of the drum end or at least in extremely close proximity to the surface of the drum end. By not leaving any noticeable clearance space or at most a space with only a few thousandths of an inch gap, there is effectively no room for a blade or edge of any type of utensil, implement, or hand tool to slide beneath the frangible skirt in hopes of removing the cap without this attempt being revealed by the fracture of one or more of the connecting frangible elements. As will be clearly explained, any such inserting and prying attempt causes the fracture of at least one of the frangible elements and this is sufficient to reveal (visually) that a tampering attempt has been tried. This tamper-evidencing feature is further enhanced by the dimensioning of the skirt relative to the snap-on portion such that with the nominal dimensions present the skirt is actually preloaded against the upper surface of the drum in one embodiment of the present invention. In a related embodiment of the present invention, the axial and radial spacing between the lower edge of the skirt and the lower edge of the snap-on lip of the cap are such that direct contact between the lower edge of the skirt and the upper surface of the drum end is not needed.

SUMMARY OF THE INVENTION

A unitary, plastic, snap-on overcap for providing a tamper-evident capability to a closure assembly of a container according to one embodiment of the present invention comprises a cap, a removable skirt, and a plurality of spaced-apart frangible elements connecting together the removable skirt and the cap. The closure assembly which is anchored to the container includes an internally-threaded fitting and a closing plug which is threadedly installed into the fitting. The cap portion of the overcap includes a depending sidewall which terminates in a snap-on lip portion. The removable skirt includes a wall portion which is constructed and arranged to be positioned in close proximity to an upper surface of the container when the cap is snapped onto the closure assembly. The snap-on assembly involves the lip portion of the cap engaging a cooperating lip portion of the closure assembly. Access to the lip portion of the cap in order to pry the cap free from the closure assembly is not possible until the skirt is removed from the cap, a step which requires the severing of the plurality of spaced-apart frangible elements.

One object of the present invention is to provide an improved unitary, plastic, snap-on overcap for providing a tamper-evident capability.

Related objects and advantages of the present invention will be apparent from the following description.

DESCRIPTION OF THE PREFERRED EMBODIMENTS

Figure 1:
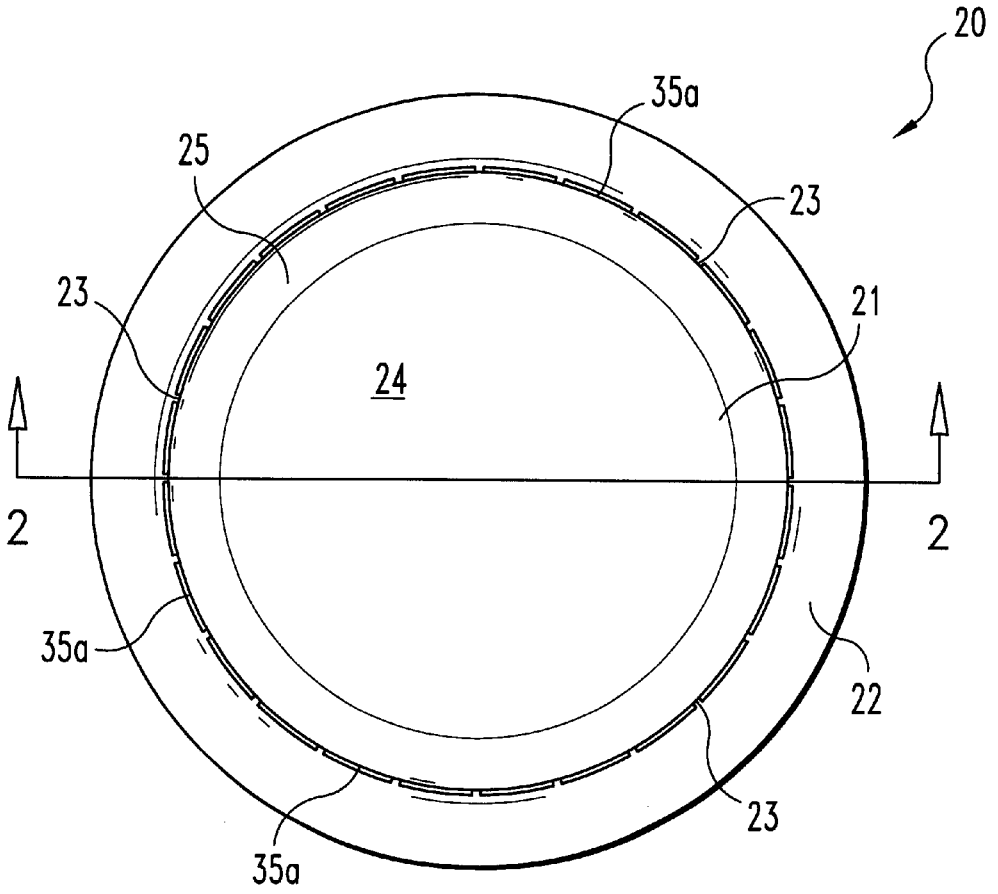
FIG. 1 is a top plan view of a molded, plastic, snap-on overcap according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
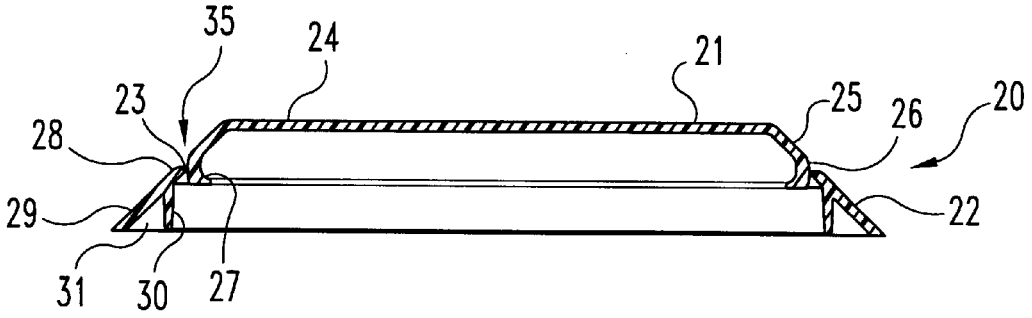
FIG. 2 is a front elevational view in full section of the FIG. 1 overcap as viewed along line 2—2 in FIG. 1.
Figure 3:
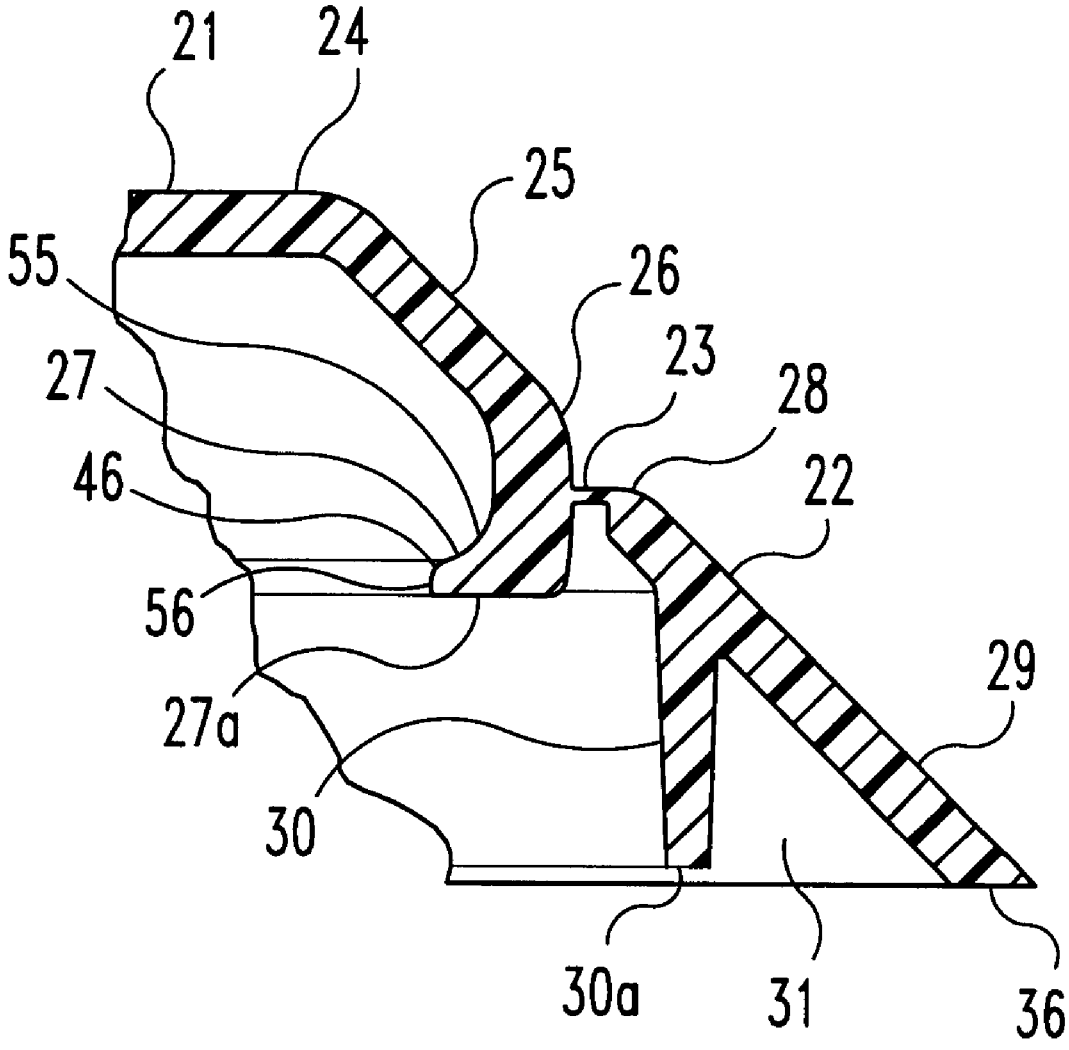
FIG. 3 is a enlarged detail, side elevational view of one portion of the FIG. 2 illustration.

Referring to FIGS. 1, 2, and 3, there is illustrated a unitary, molded plastic, snap-on overcap 20 which includes a cap 21, removable tamper-evident skirt 22, and a circumferential series of frangible elements 23. The cap 21 is a circular form with a substantially flat upper surface 24, an inclined outer wall 25, a cylindrical lower wall 26, and a continuous annular snap-on lip 27. The skirt 22 includes an annular connecting lip 28, an inclined outer surface 29, and a substantially cylindrical inner wall 30. The inner wall 30 extends from the vicinity of connecting lip 28 and is radially inside of the outer wall 29 so as to define an intermediate annular clearance space 31 located between the inner wall 30 and outer wall 29. The frangible elements 23 connect the lower wall 26 with the connecting lip 28. There are a total of 24 frangible elements which are equally spaced around the circumference of lower wall 26.

In the preferred embodiment the cap has an outside diameter of approximately 3.25 inches (8.26 cm) and a height of approximately 0.36 inches (9.14 mm). The centerline-to-centerline spacing between adjacent frangible elements 23 is approximately 15 degrees. The angle of incline of outer wall 25 is approximately 45 degrees and the axial height of lower wall 26 is approximately 0.15 inches (3.81 mm). Lip 27 has a radial width of approximately 0.12 (3.05 mm) inches and a substantially horizontal lower surface 27(*a*). Lip 27 provides the snap-on capability for overcap 20 by sizing lip 27 relative to a screw-in plug 39, as will be described hereinafter, such that the lip 27 fits around and beneath a radially-extending flange 40 which comprises part of the screw-in plug 39 (see FIGS. 4, 5, and 6).

While the connecting lip 28 and the lower wall 26 are joined together by the 24 frangible elements 23 as part of the unitary, molded plastic overcap 20, there is a clearance space 35 located between the cap 21 and the skirt 22. This clearance space 35, while generally annular in form, is actually segmented by the 24 frangible elements 23 into 24 arcuate portions 35*a*.

The axial position of the skirt 22 relative to cap 21 is defined by the axial position of the under surface 36 of outer wall 29 relative to the axial position of lip 27. Functionally, as the lip 27 snaps onto the flange 40 of plug 39 it is intended for under surface 36 to engage the upper surface 41 of drum end 42 (see FIG. 6). It is preferred for these axial heights (i.e., dimensions) to be set so that there is actually a slight preload applied to the outer wall 29 of skirt 22 after the snap-on of cap 21 onto the flange 40 of plug 39 is completed. This preload causes a slight degree of flexing in the outer wall 29 as it pushes down on upper surface 41. Since the plug 39 is threaded into the flange fitting 43 which is anchored into the drum end 42, there is a further interfit relationship which must be taken into consideration.

Beginning with the drum end 42 and the flange fitting 43 installed therein, a threaded aperture 44 is defined for receipt of the externally-threaded plug 39. The outwardly-radiating flange 40 of the plug 39 (the snap-on portion for the cap) is drawn closer to the upper surface of raised portion 41*a* of upper surface 41 as the plug 39 is threaded advanced into the aperture 44 of the flange fitting 43. An annular gasket 47 is positioned around the threaded body of plug 39 and beneath flange 40. This gasket 47 is captured by and compressed between the underside surface 45 of flange 40 and upper surface of raised portion 41*a* by the threaded advancement of the plug 39 into aperture 44. The gasket 47 helps to ensure a sealed interface and provides spacing beneath surface 45 and above raised portion 41(*a* )for lip 27 to fit into as it snaps onto the outer peripheral edge of flange 40. Once the plug is "fully seated", meaning that the gasket 47 is compressed to the desired extent, the axial height (i.e., separation) between the underside surface 45 of the flange 40 and the upper surface 41 is set at a nominal distance of approximately 0.205 inches (5.21 mm)(dimension A). In a cooperating manner, the upper side surface 46 of the inner tip of lip 27 is axially spaced from under surface 36 a nominal distance of approximately 0.215 inches (5.46 mm) (dimension B). The nominal difference of approximately 0.010 inches (0.25 mm) between dimensions A and B creates the slight preload on skirt 29 as it is pressed against upper surface 41.

The nominal dimensions for overcap 20 mean that the under surface 36 of outer wall 29 axially extends 0.012 inches (0.30 mm) below the lower surface 30*a* of inner wall 30. However, the tolerances on the corresponding axial dimensions mean that the lower surface of inner wall 30 could abut up against the upper surface 41 of the drum end before the under surface 36 engages this upper surface 41. While the dimensional stack indicates a maximum possible 0.008 inches (0.2 mm) of separation between surface 36 and surface 41, this is still small enough to prevent the use of a tool to try and pry off the cap without first breaking one or more of the frangible elements 23.

Inner wall provides an additional degree of stiffness and rigidity to skirt 22, and in particular to outer wall 29. The axial height of inner wall 30 is set so as to be recessed relative to under surface 36 by approximately 0.012 inches (0.30 mm)(nominal). As the outer skirt 22 is preloaded against upper surface 41, the inner wall 30 provides an axial abutment so that the preload is not excessive. If the axial dimensions and relationships are such that the outer wall 29 of skirt 22 could otherwise be pushed too far into preloaded engagement to the point of fracturing one or more frangible elements, the inner wall 30 prevents this from occurring.

Figure 4:
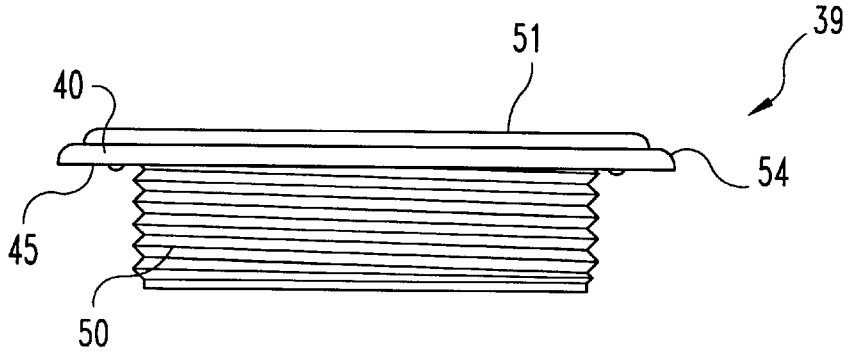
FIG. 4 is a front elevational view of a closing plug comprising one portion of a closure assembly which cooperates with the FIG. 1 overcap in order to provide a tamper-evident capability.
Figure 5:
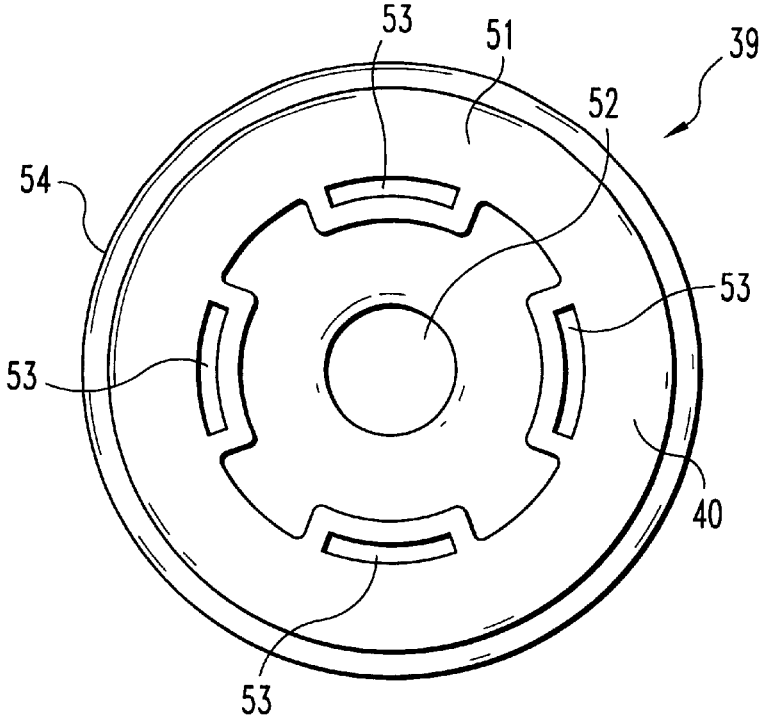
FIG. 5 is a top plan view of the FIG. 4 closing plug.

With reference to FIGS. 4 and 5, the externally-threaded, molded closing plug 39 is illustrated. Plug 39 has a unitary construction which includes a closed, externally-threaded body 50 which is received by the threaded aperture 44 of flange fitting 43. Included at the upper end of body 50 is flange 40 which has a substantially cylindrical form, though relatively shallow, and radiates in an outwardly direction beyond the periphery of body 50. Flange 40 includes upper surface 51 and underside surface 45. Upper surface 51 is contoured with a recessed center portion 52 and four equally-spaced wrench slot 53 which are used for the automatic assembly of plug 39 into aperture 44. Since the threaded advancing of plug 39 into aperture 44 is countered and resisted by the compression of gasket 47, a torque measurement can be used to set the position of the plug 39 relative to aperture 44 and to also set the degree of compression of gasket 47.

Figure 6:
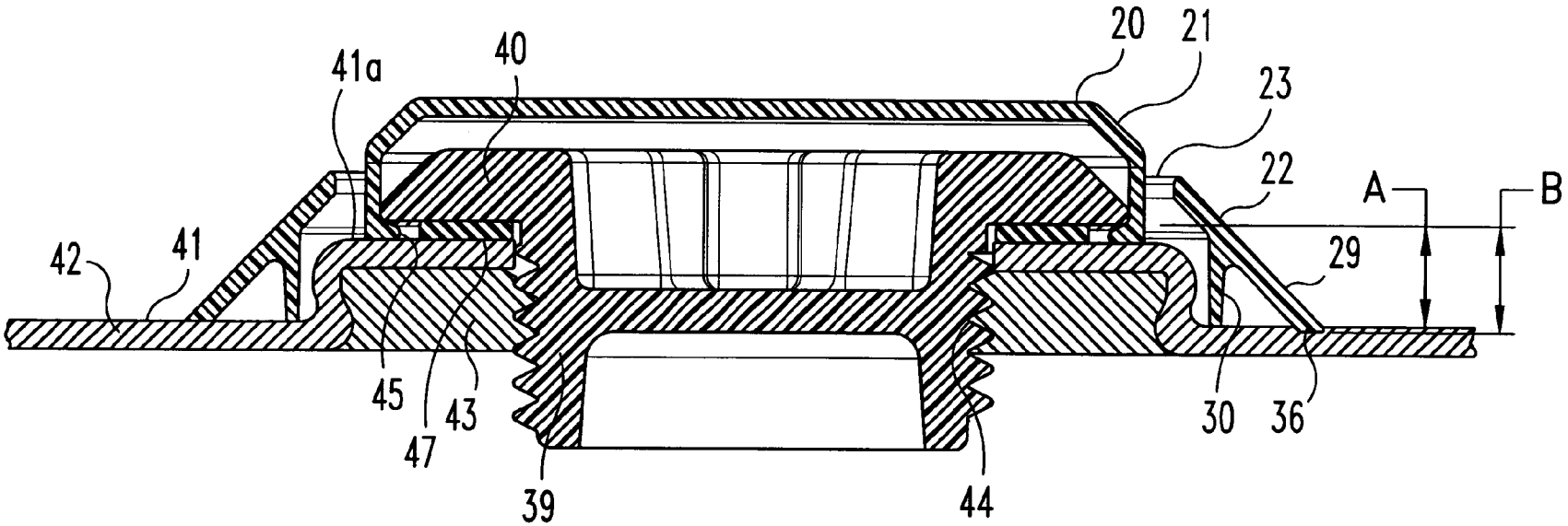
FIG. 6 is a front elevational view in full section of the initial assembly involving a container, a flange fitting installed in the container, the FIG. 4 closing plug, and the FIG. 1 overcap.
Figure 7:
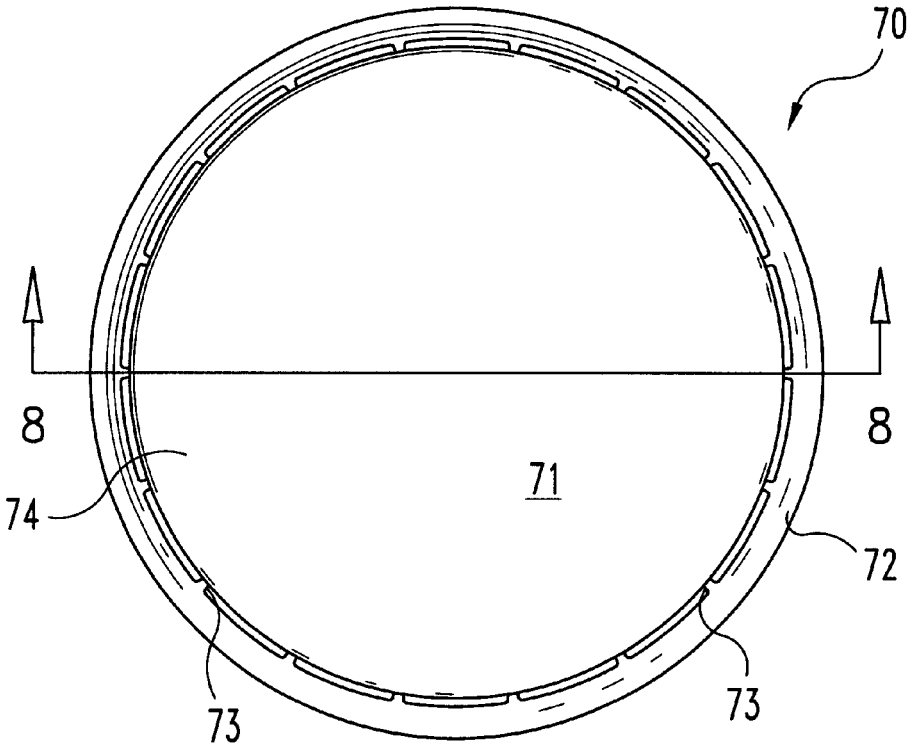
FIG. 7 is a top plan view of a unitary, plastic, snap-on overcap according to another embodiment of the present invention.
Figure 8:
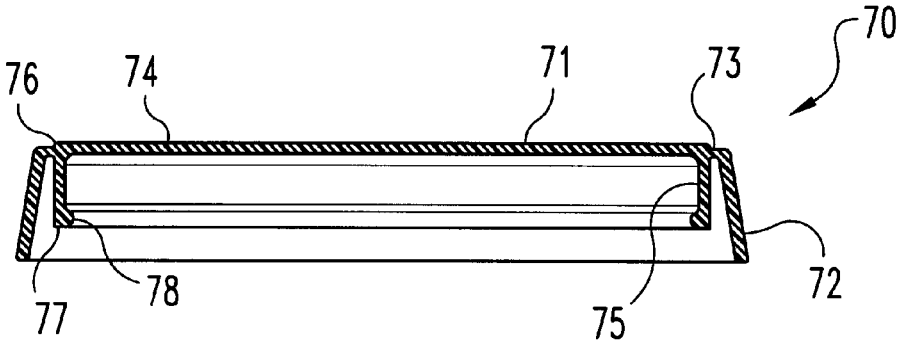
FIG. 8 is a front elevational view in full section of the FIG. 7 overcap as viewed along line 8—8 in FIG. 7.
Figure 9:
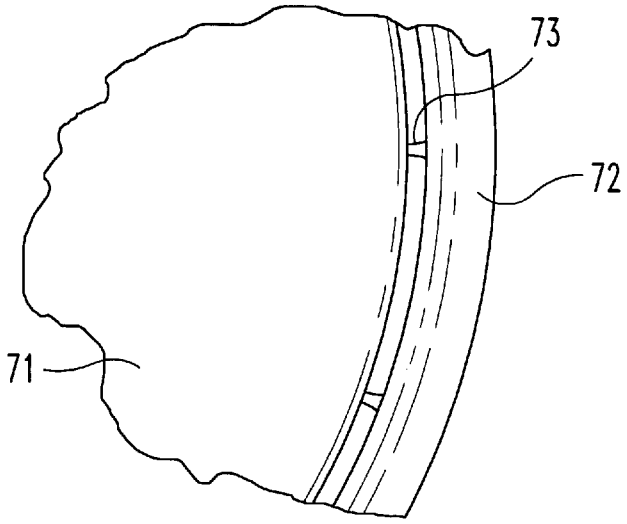
FIG. 9 is an enlarged detail view of one portion of the FIG. 7 illustration.
Figure 10:
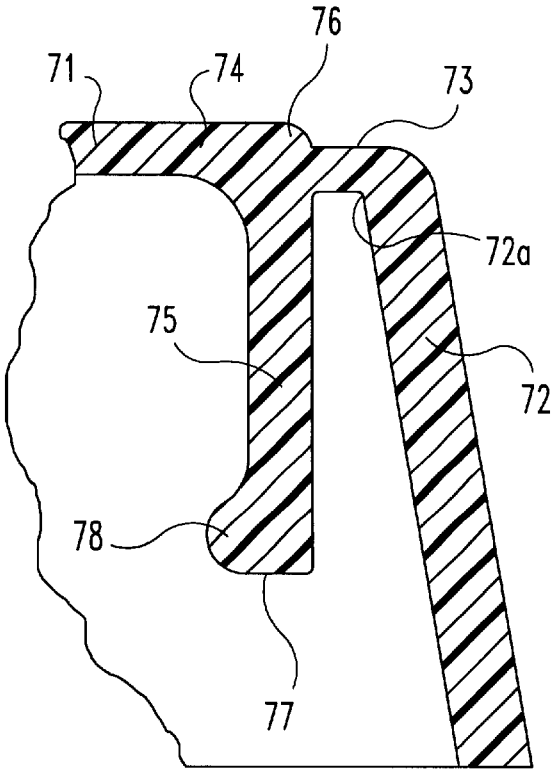
FIG. 10 is an enlarged detail view of one portion of the FIG. 8 illustration.

In a free state, flange fitting 43 is configured with a serrated outer edge and a slightly inclined flange portion leading to and defining the internally-threaded aperture 44 (see FIG. 6). The manner in which this flange fitting 43 is captured and secured within the formed pocket of the drum end is well known in the art and results in the final form which is diagrammatically illustrated in FIG. 6.

Since aperture 44 is a through aperture, the plug 39 would be able to be threaded into the aperture until the underside surface 45 of flange 40 comes in contact with the drum end portion (i.e., raised portion 41*a*) which extends over the upper surface of the flange fitting 43. However, the presence of annular gasket 47 prevents the flange 40 from bottoming out on the raised surface 41*a*. In the assembled configuration including the annular gasket 47, the outer edge of flange 40 is spaced apart from the upper surface of raised portion 41*a* by approximately 0.146 inches (3.71 mm). The clearance space left beneath the outer edge 54 of flange 40 is important so that lip 27 is able to snap beneath flange 40 for the described snap-fit assembly of the overcap 20 to the plug 39. What has been identified as lip 27 is functionally a hook bead with a curved inner surface 55, rounded tip 56, and a lower surface 27*a*. Upper side surface 46 is adjacent the tip 56 and comprises one end of surface 55. Surface 46 comprises that portion of lip 27 which principally engages flange 40 for the snap-fit assembly of overcap 20. The inside diameter of lip 27 measures approximately 3.012 inches (7.65 cm). Since the flange 40 of plug 39 has an outside diameter that measures approximately 3.075 inches (7.81 cm), lip 27 must flex in order to snap onto the plug 39. However, once the lip 27 is positioned beneath flange 40, this diameter size difference ensures that the overcap will remain on the plug unless the cap is destroyed or pried off. As illustrated in FIG. 6, the cap 21 snaps onto the plug 39 and is free of any direct connection to the container, represented in part by drum end 42. The skirt 22 is also free of any direct connection to the container.

When it is time to properly access the contents of the drum, the skirt is separated from the cap by a prying action or by a severing step so as to break enough of the frangible elements so as to have access to the lower edge of the cap. The cap is then able to be pried off and the plug 39 can then be unscrewed and removed from the internally threaded aperture. Manual removal by prying is likely the easiest and safest removal technique and requires only a simple prying implement, such as a screwdriver. Alternatively, the cap can be pulled off with pliers or cut or severed in some fashion to free it from the plug. Cutting or severing are felt to be less desirable approaches.

With reference to FIGS. 7, 8, 9, and 10, another embodiment of the present invention is illustrated. This second embodiment is directed to a unitary, molded plastic overcap 70 which includes a cap 71 and a removable skirt 72 which is connected to cap 71 by a plurality of frangible elements 73. In the illustrated embodiment there are a total of eighteen frangible elements which are equally spaced apart with centerline-to-centerline intervals each measuring approximately 20 degrees.

Cap 71 has a closed, generally circular and substantially flat top 74 and a generally cylindrical sidewall 75. The top 74 and sidewall 75 are joined (unitary construction) at circumferential edge 76. The lower end 77 of sidewall 75 includes an inwardly directed continuous annular lip 78 which constitutes a hook bead for the snap-fit of overcap 70 onto a formed peripheral edge of a flange fitting 82 (see FIG. 11). The frangible elements 73 are generally positioned adjacent to circumferential edge 76 where the top 74 and sidewall 75 meet. The precise location is slightly below the uppermost surface of edge 76 and a little closer to the upper end of sidewall 75. The frangible elements 73 connect this portion of cap 71 to the inside surface 72*a* of the uppermost portion of skirt 72.

The flange fitting 82 has an octagonally-shaped flange 83 and a substantially cylindrical, sleeve-like sidewall 84 which defines an internally-threaded, annular aperture 85 which receives an annular metal closing plug 86. The fitting 82 is designed to fit within a drawn pocket 87 in the drum end and this drawn pocket captures the octagonally-shaped flange 83 and permits the sidewall 84 to axially extend above a drawn pocket annular sidewall 88. The upper lip 89 of the sidewall 84 is rolled over the top edge 90 of the drawn pocket sidewall 88 as a way of axially anchoring the flange fitting in position (see FIG. 11). Plug 86 has a closed base 86(a )and an externally-threaded sidewall 86*b* for threaded engagement with aperture 85 so as to close the opening in the drum end which is defined by aperture 85. The free end 91 of the upper lip 89 is used as the edge for snap-fit cooperation with annular lip 78 (i.e., the hook bead). An annular gasket 95 is positioned around the plug body (i.e., sidewall 86*b*) directly beneath outwardly-radiating annular lip 96. As the plug 86 is threadedly advanced into aperture 85, the lip 96 draws the gasket 95 into sealing engagement against the uppermost thread of aperture 85 of flange fitting 82. As gasket compression occurs, the gasket 95 is pushed into engagement with the inner surface of sidewall 84 at a location adjacent upper lip 89 as is begins to bend in order to extend of the top edge 90.

Figure 11:
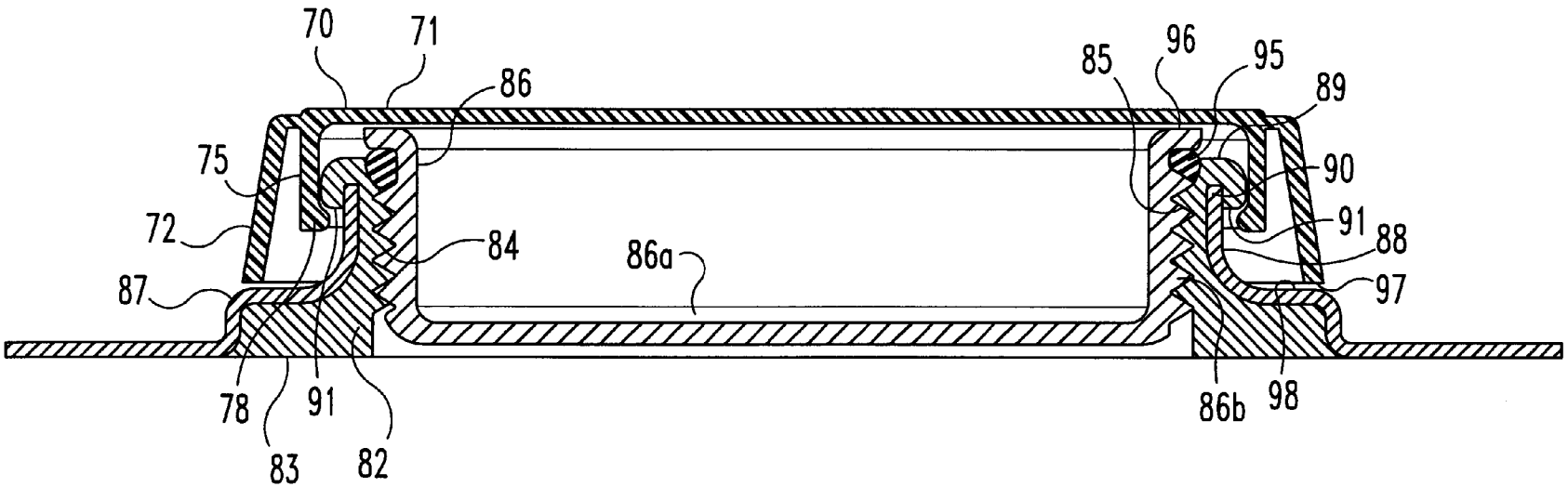
FIG. 11 is a front elevational view in full section of the initial assembly of a container, a flange fitting installed within the container, a closing plug installed within the flange fitting, and the FIG. 7 overcap.

In the final assembly of flange fitting 82, plug 86 and overcap 70, as illustrated in FIG. 11, it will be seen that the lip 78 of cap sidewall 75 is snapped over and around the free end 91 of the upper lip 89. At the same time, the underside surface 97 of the removable skirt 72 is positioned directly above the upper surface 98 of drawn pocket 87. This pocket 87 which is formed by drawing the metal of the drum end into an octagonally-shaped pocket has a substantially flat upper surface 98 which extends completely around the sidewall 88 of pocket 87. Since there is only a very slight clearance (0.010–0.020 inches)(0.25–0.51 mm) between surface 98 and surface 97, there is not sufficient space for any type of tool, implement, or utensil to be inserted therein in order to pry off cap 71 without at least one of the frangible elements 73 being broken. If even one frangible element is broken, this would indicate that some type of tampering effort may have been attempted. The axial offset between the lower surfaces of the sidewall 75 and the skirt 72 as well as their radial separation make it virtually impossible to insert any type of tool, implement, or utensil into the slight clearance space and then lift up on the skirt in order to try and reach the lip 78 of the cap without at least one of the frangible elements 73 breaking. Consequently, the overcap 70 provides a unique and very effective tamper-evident structure for use with flange fittings and drum assemblies of the type and style illustrated herein. As illustrated in FIG. 11, the cap 71 snaps onto the upper lip 89 of fitting 82 and is free of any direct connection to the container, represented in part by drawn pocket 87. The outer skirt 72 is also free of any direct connection to the container.

There is always some risk that through careless handling or other inadvertent activities, one or more of the frangible elements will be broken and thereby send a false signal of a tampering attempt. However, the minimal distance of separation between the cap and the skirt, in both of the illustrated embodiments, and the limited clearance space or line-to-line fit of the lower edge of the skirt against the upper surface of the drum end strongly suggests that breakage of any frangible elements through an inadvertent act is highly unlikely.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A unitary, plastic, snap-on overcap for providing a tamper-evident capability to a closure assembly of a container which assembly includes an internally-threaded fitting anchored to said container and a closing plug installed into said fitting, said overcap comprising:

a cap including a depending sidewall terminating in a continuous annular snap-on lip portion, said lip portion being constructed and arranged for engaging a portion of said closure assembly and said cap being free of any direct connection to said container;

a removable skirt including a wall portion constructed and arranged to be positioned in close proximity to an upper surface of said container when said cap is snapped onto said closure assembly, said removable skirt being free of any direct connection to said container; and a plurality of spaced-apart frangible elements connecting together said removable skirt and said cap, such that severing of said plurality of spaced-apart frangible elements enables the separation of said removable skirt from said cap.

2. The snap-on overcap of claim 1 wherein said wall portion has an inclined configuration such that it extends outwardly in a radial direction as it extends away from said cap and toward said container.

3. The snap-on overcap of claim 2 wherein said cap includes a vertical wall portion and said plurality of spaced-apart frangible elements are attached to said vertical wall portion.

4. The snap-on overcap of claim 3 wherein said removable skirt is constructed and arranged relative to said lip portion such that said removable skirt is located radially outwardly of said lip portion and overlaps said lip portion, thereby precluding access to said lip portion until said removable skirt is removed.

5. The snap-on overcap of claim 4 wherein said portion of said closure assembly includes an outer peripheral edge of said closure plug.

6. The snap-on overcap of claim 4 wherein said portion of said closure assembly includes a peripheral lip of said internally-threaded fitting.

7. The snap-on overcap of claim 1 wherein said removable skirt is constructed and arranged relative to said lip portion such that said removable skirt is located radially outwardly of said lip portion and overlaps said lip portion, thereby precluding access to said lip portion until said removable skirt is removed.

8. The snap-on overcap of claim 7 wherein said wall portion has an inclined configuration such that it extends outwardly in a radial direction as it extends away from said cap and toward said container.

9. The snap-on overcap of claim 8 wherein said portion of said closure assembly includes an outer peripheral edge of said closure plug.

10. The snap-on overcap of claim 1 wherein said cap includes a vertical wall portion and said plurality of spaced-apart frangible elements are attached to said vertical wall portion.

11. The snap-on overcap of claim 1 wherein said portion of said closure assembly includes an outer peripheral edge of said closure plug.

12. The snap-on overcap of claim 11 wherein said wall portion has an inclined configuration such that it extends outwardly in a radial direction as it extends away from said cap and toward said container.

13. The snap-on overcap of claim 12 wherein said cap includes a vertical wall portion and said plurality of spaced-apart frangible elements are attached to said vertical wall portion.

14. The snap-on overcap of claim 1 wherein said portion of said closure assembly includes a peripheral lip of said internally-threaded fitting.

15. The snap-on overcap of claim 14 wherein said wall portion has an inclined configuration such that it extends outwardly in a radial direction as it extends away from said cap and toward said container.

16. The snap-on overcap of claim 15 wherein said cap includes a vertical wall portion and said plurality of spaced-apart frangible elements are attached to said vertical wall portion.

17. A unitary, plastic, snap-on overcap for providing a tamper-evident capability to a closure assembly of a container which assembly includes an internally-threaded fitting anchored to said container and a closing plug installed into said fitting, said overcap comprising:

a cap including a depending sidewall terminating in a snap-on lip portion;

a removable skirt including a wall portion constructed and arranged to be positioned in close proximity to an upper surface of said container when said cap is snapped onto said closure assembly by said lip portion engaging a portion of said closure assembly; and a plurality of spaced-apart frangible elements connecting together said removable skirt and said cap, such that severing of said plurality of spaced-apart frangible elements enables the separation of said removable skirt from said cap, wherein said removable skirt further includes an inner depending wall which is constructed and arranged to function as an abutment wall in order to prevent the unintended severing of said plurality of spaced-apart frangible elements.

18. The snap-on overcap of claim 17 wherein said portion of said closure assembly includes an outer peripheral edge of said closure plug.

19. The snap-on overcap of claim 18 wherein said cap includes a vertical wall portion and said plurality of spaced-apart frangible elements are attached to said vertical wall portion.

20. A unitary, plastic, snap-on overcap for providing a tamper-evident capability to a closure assembly of a container, said overcap comprising:

a cap including a depending sidewall terminating in a continuous annular snap-on lip portion, said lip portion being constructed and arranged for engaging a portion of said closure assembly and said cap being free of any direct connection to said container;

a removable skirt including a wall portion constructed and arranged to be positioned adjacent to an upper surface of said container when said cap is snapped onto said closure assembly, said removable skirt being free of any direct connection to said container; and a plurality of spaced-apart frangible elements connecting together said removable skirt and said cap, such that severing of said plurality of spaced-apart frangible elements enables the separation of said removable skirt from said cap.

21. The snap-on overcap of claim 20 wherein said wall portion has an inclined configuration such that it extends outwardly in a radial direction as it extends away from said cap and toward said container.

22. The snap-on overcap of claim 21 wherein said cap includes a vertical wall portion and said plurality of spaced-apart frangible elements are attached to said vertical wall portion.

23. The snap-on overcap of claim 22 wherein said removable skirt is constructed and arranged relative to said lip portion such that said removable skirt is located radially outwardly of said lip portion and overlaps said lip portion, thereby precluding access to said lip portion until said removable skirt is removed.

24. The snap-on overcap of claim 20 wherein said removable skirt is constructed and arranged relative to said lip portion such that said removable skirt is located radially outwardly of said lip portion and overlaps said lip portion, thereby precluding access to said lip portion until said removable skirt is removed.

25. The snap-on overcap of claim 24 wherein said wall portion has an inclined configuration such that it extends outwardly in a radial direction as it extends away from said cap and toward said container.

26. The snap-on overcap of claim 20 wherein said cap includes a vertical wall portion and said plurality of spaced-apart frangible elements are attached to said vertical wall portion.

27. The snap-on overcap of claim 26 wherein said removable skirt is constructed and arranged relative to said lip portion such that said removable skirt is located radially outwardly of said lip portion and overlaps said lip portion, thereby precluding access to said lip portion until said removable skirt is removed.

* * * * *